US007097717B2

(12) United States Patent
Jung et al.

(10) Patent No.: US 7,097,717 B2
(45) Date of Patent: Aug. 29, 2006

(54) METHOD AND DEVICE FOR COLLECTING PARTICULATE CONTAMINANTS DURING $CO_2$ BLASTING DECONTAMINATION

(75) Inventors: Chong-Hun Jung, Taejon (KR); Jei-Kwon Moon, Taejon (KR); Hui Jun Won, Taejon (KR); Won-Zin Oh, Taejon (KR); Jae-Hyung Yoo, Taejon (KR)

(73) Assignees: Korea Atomic Energy Research Institute, Daejeon-Si (KR); Korea Hydro & Nuclear Power Company Ltd., Seoul (KR)

( * ) Notice: Subject to any disclaimer, the term of this patent is extended or adjusted under 35 U.S.C. 154(b) by 317 days.

(21) Appl. No.: 10/493,952

(22) PCT Filed: Nov. 21, 2002

(86) PCT No.: PCT/KR02/02172

§ 371 (c)(1),
(2), (4) Date: Apr. 28, 2004

(87) PCT Pub. No.: WO03/044805

PCT Pub. Date: May 30, 2003

(65) Prior Publication Data

US 2005/0076937 A1 Apr. 14, 2005

(30) Foreign Application Priority Data

Nov. 23, 2001 (KR) ..... 10-2001-0073174

(51) Int. Cl.
*B08B 7/04* (2006.01)

(52) U.S. Cl. ..... 134/37; 134/7; 134/19; 134/36; 134/94.1; 134/95.3; 134/102.2; 134/198; 239/290; 239/291

(58) Field of Classification Search ..... 134/7, 134/19, 36, 37, 94.1, 95.3, 102.2, 198; 239/290, 239/291

See application file for complete search history.

(56) References Cited

U.S. PATENT DOCUMENTS 5,486,383 A * 1/1996 Nowotarski et al. ..... 427/446
5,529,589 A * 6/1996 Lynn et al. ..... 51/293

FOREIGN PATENT DOCUMENTS

| | | |
|---|---|---|
| JP | 10-068800 | 3/1998 |
| KR | 1999-0040499 | 6/1999 |
| KR | 1020000074657 | 12/2000 |
| KR | 1020020067783 | 8/2002 |

* cited by examiner

*Primary Examiner*—Zeinab El-Arini
(74) *Attorney, Agent, or Firm*—Arent Fox PLLC

(57) ABSTRACT

Disclosed is a method and device for collecting particulate contaminants removed using a $CO_2$ decontamination medium from an early step of a decontamination process. The device removes particulate contaminants from a contaminated subject by a decontamination stream, and simultaneously forms another stream for collecting such contaminants into a collecting filter, thus preventing such contaminants from diffusing into the atmosphere. The device forms streams between the nozzles and the surface of the contaminated subject to readily move the nozzles along the surface of the subject without frictional resistance, to reduce the sense of fatigue of the operator. The method and device are advantageous in that when the device is readily used with a conventional $CO_2$ blasting decontamination unit to collect particulate contaminants, removal of particulate contaminants from a contaminated subject and collection of particulate contaminants contained in the decontamination stream are simultaneously performed, also allowing compressed gas blasted through air curtain blasting nozzles to prevent contaminated gas from diffusing into the atmosphere.

5 Claims, 3 Drawing Sheets

METHOD AND DEVICE FOR COLLECTING PARTICULATE CONTAMINANTS DURING $CO_2$ BLASTING DECONTAMINATION

This application is a national stage application and claims the benefit of the PCT international application No. PCT/KR 02/02172 filed Nov. 21, 2002.

BACKGROUND OF THE INVENTION

1. Field of the Invention

The present invention relates to a method and device for collecting particulate contaminants removed using a $CO_2$ decontamination medium from an early stage of a decontamination process. More particularly, the present invention relates to a device for collecting particulate contaminants during a $CO_2$ blasting decontamination process, which is readily combined with a conventional $CO_2$ blasting nozzle unit to collect particulate contaminants, allowing compressed gas blasted through an air curtain blasting nozzle of the device to prevent contaminated gas from diffusing into the atmosphere, and sucking particulate contaminants into a separate collecting filter, and a method of collecting particulate contaminants using the device.

2. Description of the Prior Art

As well known to those skilled in the art, recently, $CO_2$ decontamination processes have attracted considerable attention even though these various decontamination processes are applied to industrial fields. In comparison with conventional chemical and physical decontamination processes, the $CO_2$ decontamination process has advantages of cleanness, rapid decontamination speed, and not producing secondary wastes, thus it is frequently applied to various fields such as atomic piles, semiconductor fabrication, and optical and medical equipment.

If $CO_2$ gas at a very low temperature passes through an orifice of a nozzle under conditions in which liquid phase and vapor phase coexist (pressure of 800 psi) to be dropped to 80 psi in pressure, a portion of high-pressure $CO_2$ gas (about 45%) is converted into solid granules like snow. These granules consist of crystal particles of sub-micron units, and are blasted onto a subject which is to be decontaminated. This is a $CO_2$ snow-blasting decontamination process.

Additionally, there is a conventional $CO_2$ pellet-blasting decontamination process, in which solid previously-prepared granules are compressed to form predetermined lump-like shapes, and these lumps, or so-called pellets, are blasted onto a contaminated subject to decontaminate the subject.

According to these conventional decontamination processes, a $CO_2$ decontamination medium ($CO_2$ snow or $CO_2$ pellets), when blasting through a nozzle to a surface of a contaminated subject, transfers its collision energy into particulate contaminants to remove them. However, these processes are disadvantageous in that a separate collecting process is additionally needed, thus inevitably increasing decontamination cost.

Other disadvantages of the above processes are that particulate contaminants removed by the $CO_2$ decontamination medium are instantaneously diffused into the atmosphere by the blasting gas, and a freezing layer is formed on a surface of the contaminated subject because a temperature of the blasted $CO_2$ gas is very low, thus reducing decontamination efficiency of the contaminated subject.

SUMMARY OF THE INVENTION

Therefore, the present invention has been made keeping in mind the above disadvantages occurring in the prior art, and an object of the present invention is to provide a device for collecting particulate contaminants which removes particulate contaminants from a contaminated subject by a decontamination stream and simultaneously forms another stream for collecting such contaminants into a collecting filter, prevents such contaminants from being diffused into the atmosphere, and forms buoyancy between the nozzle and the surface of the contaminated subject by the aforementioned streams, to readily move the nozzle along the surface of the subject without frictional resistance, thereby reducing the fatigue of an operator, and a method of collecting particulate contaminants using the device.

Based on the present invention, the above object can be accomplished by the provision of a device for collecting particulate contaminants which forms a shielding stream, surrounding a decontamination stream blasted from a blasting nozzle, using compressed air to prevent contaminants from diffusing into the atmosphere and collecting particulate contaminants contained in the decontamination stream into a collecting pipe, and a method of collecting particulate contaminants using the device. In other words, the method and device of the present invention are characterized in that when this device is readily combined with a conventional $CO_2$ blasting decontamination unit to collect particulate contaminants, removal of particulate contaminants from a contaminated subject and collection of particulate contaminants contained in the decontamination stream are simultaneously performed, and compressed gas is blasted through air curtain blasting nozzles to prevent contaminated gas from diffusing into the atmosphere.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
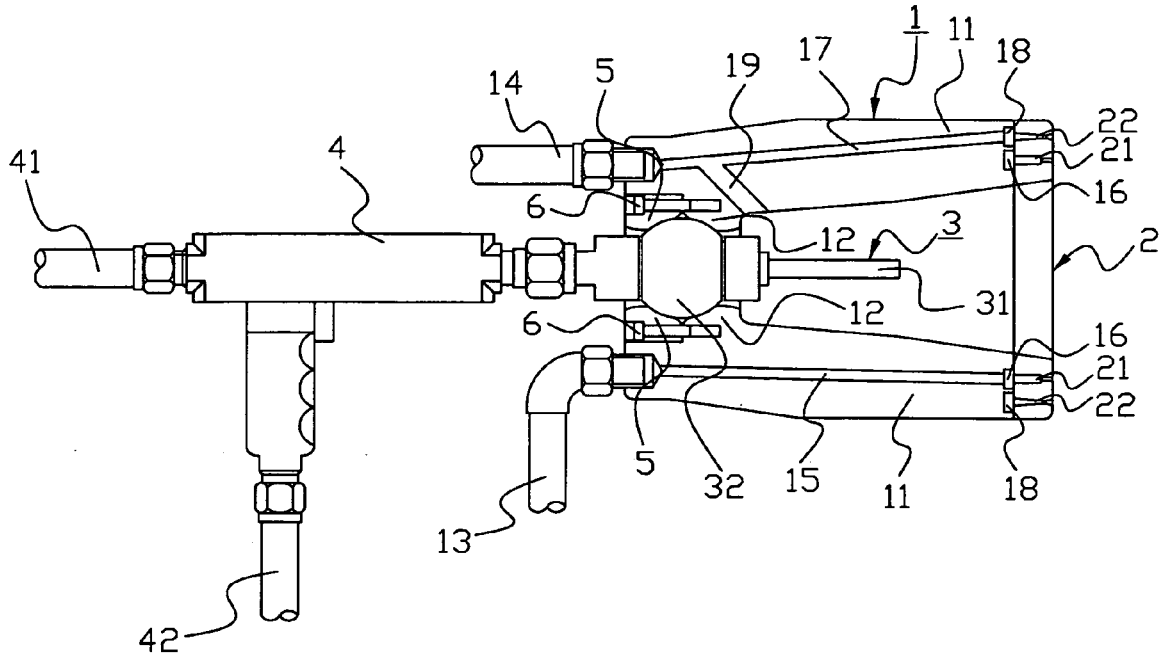
FIG. 1 is a front view of a device for collecting particulate contaminants according to a preferred embodiment of the present invention.

Reference now should be made to the drawings, in which the same reference numerals are used throughout the different drawings to designate the same or similar components.

Figure 2:
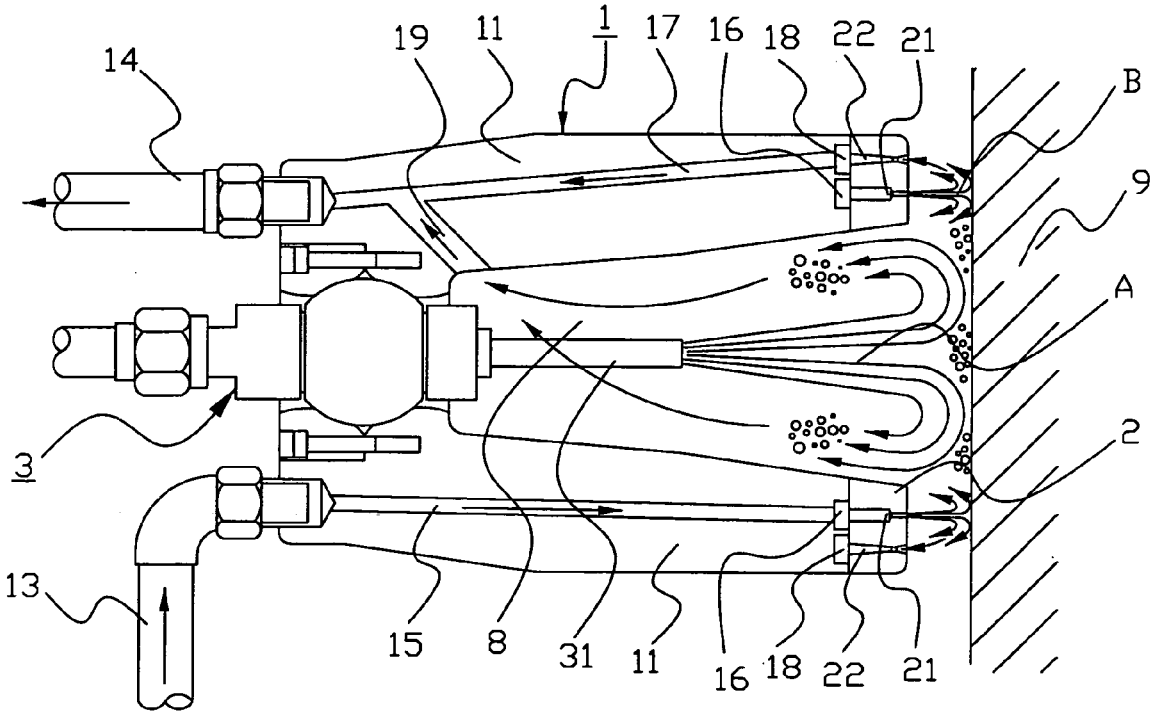
FIG. 2 is a partial enlarged view of FIG. 1.
Figure 3:
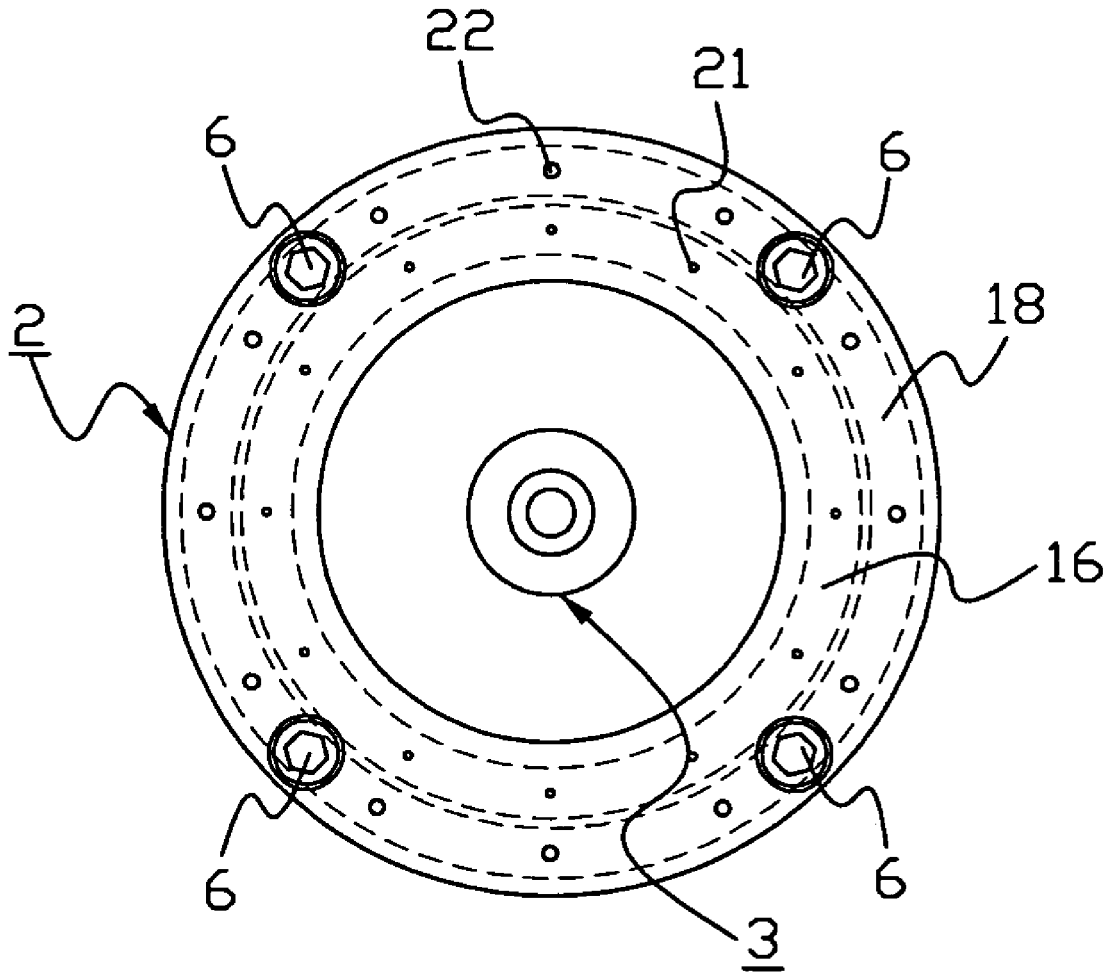
FIG. 3 is a partial side view of the device for collecting particulate contaminants according to the present invention.

FIG. 1 is a front view of a device for collecting particulate contaminants according to a preferred embodiment of the present invention, FIG. 2 is a partial enlarged view of FIG. 1, and FIG. 3 is a partial side view of the device for collecting particulate contaminants according to the present invention. The device according to the present invention comprises a $CO_2$ blasting decontamination unit for blasting a $CO_2$ decontamination medium in conjunction with compressed gas onto a contaminated subject 9. At this time, the $CO_2$ blasting decontamination unit includes a blasting nozzle part 4, which is connected to a $CO_2$ decontamination medium feeding port 42 and a compressed gas feeding port 41. An induction nozzle part 3 for blasting the $CO_2$ decontamination medium communicates with the blasting nozzle part 4, and a main body 1 for guiding the compressed gas and the particulate contaminants is set around the induction nozzle part 3, such that the main body 1 partly surrounds the induction nozzle part 3. The device of the present invention also includes a cap 2, set at an end of the main body 1. The cap 2 is provided with an air curtain blasting nozzle 21 for forming a shielding stream B using the compressed gas fed through the main body 1.

The induction nozzle part 3 and the main body 1 are connected to each other in a ball-joint connecting manner so as to readily change the blasting direction of the induction nozzle part 3. In detail, an outer ring 32 is set around a center of the induction nozzle part 3, a housing part 12, extended from the main body 1, is installed to come in contact with a portion of the outer ring 32, and a housing cap 5 is assembled with the housing part 12 by a housing bolt 6 such that the cap 5 comes in contact with another portion of the outer ring 32, thus connecting the induction nozzle part 3 to the main body 1.

The main body 1 is connected to a compressed gas feeding port 13 for feeding compressed gas into the main body 1 and a contaminant discharge port 14 for moving the particulate contaminants to a separate collecting filter to guide the compressed gas, fed through the compressed gas feeding port 13, to the surface of the contaminated subject 9 and simultaneously guides particulate contaminants in a decontamination stream A to the contaminant discharge port 14. At this time, the main body 1 comprises a guide part 11 surrounding the induction nozzle part 3, and a contaminant suction channel 17 extended throughout the guide part 11 and connected to the contaminant discharge port 14. A compressed gas feeding channel 15 is extended throughout the guide part 11 and connected to the compressed gas feeding port 13. Additionally, a contaminant guiding groove 18 for guiding the particulate contaminants is formed in a shape of circular band around an end of the contaminant suction channel 17, and a compressed gas guiding groove 16 for guiding the compressed gas is formed in a shape of circular band around an end of the compressed gas feeding channel 15. The main body 1 also includes a collecting pipe 19 for connecting a collecting space which collects the particulate contaminants formed by the guide part 11 to the contaminant suction channel 17, thereafter being assembled with the induction nozzle part 3. At this time, a blasting port 31 of the induction nozzle part 3 is positioned inside the guide part 11.

The cap 2 functions to blast the compressed gas to a surface of the contaminated subject 9 to form a shielding stream B and simultaneously suck particulate contaminants contained in the shielding stream B, and includes a plurality of venturi suction nozzles 22 arranged in a circle to correspond to the contaminant guiding groove 18 and the plurality of air curtain blasting nozzles 21 arranged in a circle to correspond to the compressed gas guiding groove 16. Additionally, the cap 2 is assembled with the main body 1 by bolts.

In other words, the compressed gas, fed through the compressed gas feeding channel 15, is blasted through a plurality of air curtain blasting nozzles 21 positioned along the compressed gas guiding groove 16 to form the shielding stream B surrounding the decontamination stream A, and particulate contaminants, passing through the shielding stream B, are sucked into a plurality of venturi suction nozzles 22, positioned outside the air curtain blasting nozzles 21 without being diffused to the atmosphere, thereby preventing diffusion of particulate contaminants into the atmosphere.

An operation of the device according to the present invention will be described, below.

The $CO_2$ decontamination medium, fed through the decontamination medium feeding port 42 and the compressed air feeding port 41 to the blasting nozzle part 4, is blasted through the induction nozzle part 3, extended from the blasting nozzle part 4, to the surface of the contaminated subject 9, to form the decontamination stream A. Simultaneously, the compressed gas, fed through the compressed gas feeding port 13 to the main body 1, flows through the compressed gas feeding channel 15 of the main body 1, into the compressed gas guiding groove 16, to be blasted through a plurality of air curtain blasting nozzles 21 arranged in a circle in the cap 2 along the compressed gas guiding groove 16, to form the shielding stream B, surrounding the decontamination stream A.

At this time, compressed air or nitrogen gas is used as the compressed gas.

The shielding stream B, thus formed, shields the collecting space 8 formed by the guide part 11 from the atmosphere, to prevent particulate contaminants in the decontamination stream A from diffusing to the atmosphere, and induces the decontamination stream A into the collecting pipe 19, thereby readily allowing movement of the nozzle without frictional resistance because of a bearing effect, due to buoyancy of streams between the nozzles and the surface of the contaminated subject 9.

When the decontamination stream A is induced into the collecting pipe 19 by the shielding stream B, particulate contaminants are sucked into the collecting pipe 19 by a suction pump (not shown) and collected through the contaminant discharge port 14 and the collecting filter (not shown).

At this time, a plurality of venturi suction nozzles 22 positioned outside the air curtain blasting nozzles 21 suck the shielding stream B to prevent particulate contaminants contained in the shielding stream B from diffusing into the atmosphere, and particulate contaminants sucked into the venturi suction nozzles 22 are moved along the contaminant guiding groove 18 into the contaminant suction channel 17 to be collected through the contaminant discharge port 14.

Additionally, the compressed gas may be fed through the air curtain blasting nozzles 21 in conjunction with a hot stream so as to prevent the contaminated subject from freezing.

As described above, the device for collecting particulate contaminants according to the present invention is structured such that a cap, including air curtain blasting nozzles and venturi suction nozzles, is assembled at an end of a main body; a housing part positioned at another end of the main body comes into close contact with an outer ring of the induction nozzle part to connect the induction nozzle part to the main body by a housing cap; and the induction nozzle part is used with a conventional blasting nozzle to blast a decontamination stream onto the surface of a contaminated subject and simultaneously blast a separate compressed gas to form a shielding stream surrounding the decontamination stream, to collect particulate contaminants contained in the decontamination stream.

Therefore, the device is advantageous in that particulate contaminants are collected at the same time as decontamination of particulate contaminants from an early stage of a decontamination process, to eliminate the need for an additional process of collecting particulate contaminants, thereby improving workability, reducing the fatigue of an operator because of readily being able to move the nozzle without frictional resistance by a bearing effect due to buoyancy of streams between the nozzles and the surface of the contaminated subject. Another advantage is that a hot stream can be added to the compressed gas to prevent the contaminated subject from freezing.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method of collecting particulate contaminants during a $CO_2$ blasting decontamination process, in which the particulate contaminants are removed using a $CO_2$ decontamination medium, comprising:

blasting the $CO_2$ decontamination medium toward a contaminated subject to form a decontamination stream and simultaneously blasting compressed gas to form a shielding stream surrounding the decontamination stream; and inducing the decontamination stream surrounded by the shielding stream into a collecting pipe to collect the particulate contaminants contained in the decontamination stream.

2. The method according to claim 1, wherein the compressed gas is blasted onto the contaminated subject in conjunction with hot gas so as to prevent the contaminated subject from freezing.

3. A device for collecting particulate contaminants during a $CO_2$ blasting decontamination process, comprising:

a $CO_2$ blasting decontamination unit for blasting a $CO_2$ decontamination medium in conjunction with compressed air to a contaminated subject, said $CO_2$ blasting decontamination unit including a blasting nozzle part and connected to a $CO_2$ decontamination medium feeding port and a compressed air feeding port;

an induction nozzle part, communicating with the blasting nozzle part, for blasting the $CO_2$ decontamination medium;

a main body, set around the induction nozzle part such that the main body partially surrounds the induction nozzle part, for guiding compressed gas and the particulate contaminants; and a cap set at an end of the main body, said cap being provided with an air curtain blasting nozzle for forming a shielding stream using the compressed gas fed through the main body and a venturi suction nozzle for sucking a portion of the shielding stream into the main body, wherein the device removes the particulate contaminants from a contaminated subject and simultaneously collects removed particulate contaminants while shielding the particulate contaminants from entering the atmosphere by the shielding stream.

4. The device according to claim 3, wherein an outer ring is set around a center of the induction nozzle part, a housing part extended from the main body comes into contact with a portion of the outer ring, and a housing cap is assembled with the housing part by a housing bolt such that the housing cap comes in contact with another portion of the outer ring to readily change a blasting direction of an induction blasting nozzle.

5. The device according to claim 3, wherein the main body comprises:

a guide part surrounding the induction nozzle part;

a contaminant suction channel extended throughout the guide part and connected to a contaminant discharge port;

a compressed gas feeding channel extended throughout the guide part and connected to the compressed gas feeding port;

a contaminant guiding groove, formed in the shape of a circular band around an end of the contaminant suction channel, for guiding the particulate contaminants;

a compressed gas guiding groove, formed in the shape of a circular band around an end of the compressed gas feeding channel, for guiding the compressed gas; and a collecting pipe for connecting a collecting space formed by the guide part to the contaminant suction channel.

* * * * *